United States Patent [19]

Trotter

[11] 4,318,390

[45] Mar. 9, 1982

[54] ARROW RETAINER

[76] Inventor: George H. Trotter, 7107 Janey St., Shreveport, La. 71108

[21] Appl. No.: 149,891

[22] Filed: May 15, 1980

[51] Int. Cl.[3] ..... F41B 5/00

[52] U.S. Cl. ..... 124/41 A

[58] Field of Search ..... 124/41 A, 24 R, 35 A, 124/88

[56] References Cited

U.S. PATENT DOCUMENTS 3,504,659 4/1970 Babington ..... 124/41 A

*Primary Examiner*—Richard C. Pinkham
*Assistant Examiner*—William R. Browne
*Attorney, Agent, or Firm*—John M. Harrison

[57] ABSTRACT

An arrow retainer for bows including a generally flat base plate for mounting on the frame of a bow and provided with an upward standing, tensioned support having a notch in the upper surface thereof, and a cooperating support arm for engagement with the notch when the arrow retainer is in supporting configuration. A pair of spaced retaining arms are provided in biased cooperation with the support arm to support an arrow when the arrow is nocked and the bow string drawn. When the arrow is released the arrow movement and lateral pressure depresses the support and causes the support arm and the retaining arms to retract and disengage the support and the arrow, respectively, by action of the bias against the retaining arms.

11 Claims, 9 Drawing Figures

ARROW RETAINER

BACKGROUND OF THE INVENTION

1. Field of the Invention

This invention relates to bows, including compound bows, and more particularly, to an arrow retainer for use on substantially any bow, which arrow retainer is capable of initially retaining an arrow shaft in a desired location during draw of the bow string and aiming the arrow, and subsequently retracting to disengage the arrow upon release of the bow string. The arrow retainer of this invention is simple and reliable, and provides a positive support means for the arrow when the bow is in full draw configuration in order to aid in proper aiming of the arrow. The device is designed to immediately retract upon release of the bow string by operation of a bias means which is responsive to the lateral pressure of the arrow as it is released. The arrow retainer can be quickly and easily installed on substantially any bow, including compound bows, and is highly reliable in initially holding and subsequently releasing the arrow.

2. Description of the Prior Art

Heretofore, the primary means for providing a rest location for arrows in a bow, whether the bow is conventional, recurve or compound in design, is by shaping a ledge, projection, or arrow rest in or on the bow handle or grip to facilitate resting of the arrow during the draw and aiming process. Various means and techniques have been utilized to provide an elevated or shaped point of rest on or near such a ledge or projection in the bow handle. These techniques have generally taken the form of permanently mounted devices which are capable of tearing or distorting the fletching of an arrow, thereby promoting inaccuracy in the arrow's flight. By far, the most common technique utilized in conventional bows is simply resting the arrow shaft on the flat surface of a ledge or projection in the bow handle to provide a resting point during the aiming operation and a guide for the arrow while the bow string is released. As the arrow moves away from the bow the fletching must necessarily touch the ledge or projection, and this contact frequently causes a deviation, however inperceptible, in the flight of the arrow. Any damage to the arrow fletching also affects future arrow trajectory, with each shot of the arrow increasing the aggravated condition of the fletching.

More sophisticated techniques of avoiding damage to the arrow fletching and providing a positive rest for the arrow shaft include both hinged and collapsible arrow rests which initially support the arrow shaft and either collapse or swing away from the shaft upon release of the bow string. Such devices frequently fail to securely hold the arrow shaft in position because of the design of the collapsing or hinged mechanism; accordingly, while such devices are usually efficient in avoiding significant damage to arrow fletching, the bow frequently cannot be conveniently tilted or abruptly turned or moved without dislodging the arrow, and the arrow is also frequently dislodged by the wind as the bow is used.

An arrow positioning device for compound bows having synchronizing cables is disclosed in my U.S. Pat. No. 4,071,014 which issued Jan. 31, 1978. This patent discloses an arrow positioner which includes a pair of retaining fingers for engagement with an arrow and a release rod and trigger device cooperating with the retaining finger, and activated by movement of one of the synchronizing cables to permit an initial, precise positioning of the fingers into arrow-engaging position while the bow is in full draw configuration, and automatic retraction of the retaining fingers when the arrow is released.

Accordingly, it is an object of this invention to provide a new and improved arrow retainer which features a positive, secure rest for the arrow shaft and is designed to automatically retract responsive to lateral pressure of the release arrow when the bow string is released to permit little or no contact between the arrow fletching and the bow itself.

Another object of the invention is to provide an improved, automatically retracting arrow retaining or positioning device which can be mounted on substantially any bow, which includes a generally flat mount plate having an upward standing, tensioned support for removable engagement with a arm, and further including a pair of spaced, spring-biased retaining arms cooperating with the support arm for removably securing an arrow in position during full draw and of the bow and automatically releasing the arrow responsive to arrow pressure upon release of the bow string.

A still further object of the invention is to provide a new and improved arrow retaining or positioning device for mounting on bows which is capable of initially securely supporting the arrow by means of a pair of retaining fingers or arms during aiming, and subsequently releasing the arrow responsive to lateral pressure exerted by the arrow after the bow string is released to facilitate little or no contact between the bow and the arrow fletching, and corresponding minimum deviation of the arrow from an intended flight path.

Yet another object of the invention is to provide a new and improved arrow retainer which is characterized by a pair of biased, projecting fingers or arms for supporting an arrow at full draw of the bow and in any bow attitude, which fingers are caused to retract automatically by arrow "whip" or "bow" as the bow string is released to minimize contact between the fingers or arms and the arrow fletching as the arrow exits the bow string and the bow.

A still further object of the invention is to provide an arrow positioning device or retainer which can be mounted on substantially any bow, including compound bows, and which includes a mount plate having an upward standing, tensioned support for engagement with a support arm and a pair of spring biased retaining fingers for removably grasping an arrow which is nocked and drawn, which retaining arms and support arm automatically disengage the support and the arrow, respectively, responsive to lateral arrow pressure on the support, upon release of the bow string to prevent damage to the arrow fletching and to minimize accuracy in the arrow flight.

SUMMARY OF THE INVENTION

These and other objects of the invention are provided in an arrow retainer or positioning device for supporting an arrow nocked in a bow, which includes the following elements:

(1) a base having an upward standing, tensioned support carried by one end of the base and extending over a portion of the base and having a notch provided in the free standing end thereof;

(2) a support arm in pivotal cooperation with the notch provided in the support when an arrow is in functional position in the arrow retainer;

(3) a pair of retaining arms provided in spaced relationship and in generally parallel cooperation with the support arm for engaging an arrow during nocking, full draw and aiming of the arrow; and (4) Bias means in cooperation with the retaining arms causing the cooperating support arm to disengage the support and the retaining arm to disengage the arrow upon release of the bow string and the arrow as the arrow is driven from the bow and lateral arrow pressure depresses the support.

BRIEF DESCRIPTION OF THE DRAWINGS

The invention will be better understood in view of the following description presented with reference to the accompanying drawing, in which.

DESCRIPTION OF THE PREFERRED EMBODIMENTS

Figure 1:
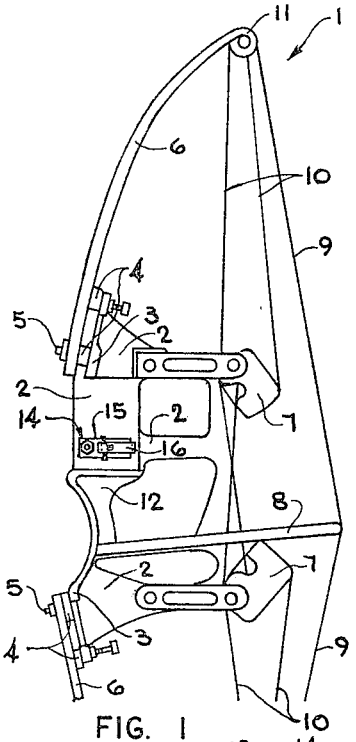
FIG. 1 is a side view, partially in section, of a compound bow equipped with the arrow retainer device of this invention.
Figure 2:
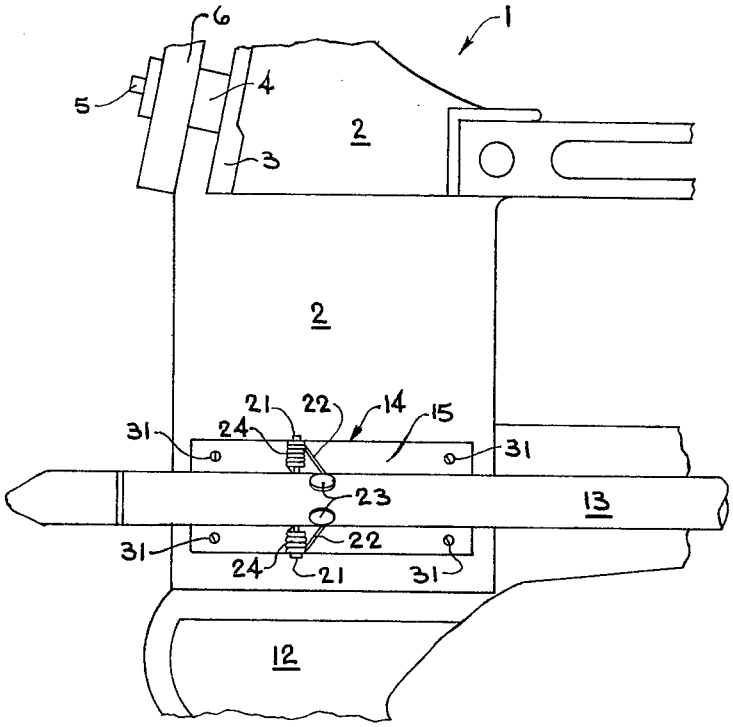
FIG. 2 is a side view of an enlarged section of the compound bow and arrow retainer illustrated in FIG. 1, more particularly illustrating an arrow positioned in the arrow retainer.
Figure 3:
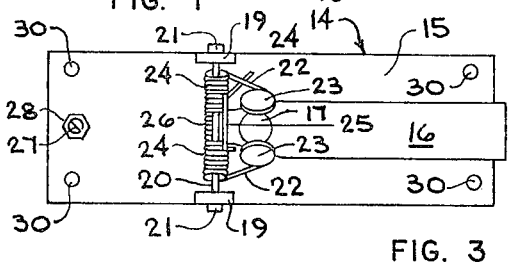
FIG. 3 is a top elevation of a preferred embodiment of the arrow retainer of this invention in cocked configuration ready to receive an arrow and with the retainer removed from side of the bow and rotated 90°.

Referring now to FIGS. 1 and 2 of the drawing, the arrow retainer of this invention is generally illustrated by reference numeral 14, and is mounted in functional position on the frame 2 of a compound bow 1, by means of mount screws 31, as illustrated. It will be appreciated by those skilled in the art that the arrow retainer 14 is illustrated on compound bow 1 for purposes of illustration only, the application being equally effective on bows of substantially any design, including recurve and long bows. Frame 2 of compound bow 1 is further characterized by a pair of limb seats 3 having limb seat pads 4, and limbs 6 anchored on limb seats 3 by means of limb anchor bolts 5. Compound bow 1 is also fitted with a pair of cams 7 and a pair of limb pulleys 11, which are orchestrated by tension cables 10 responsive to the pull of a bow string 9, resting on bow string positioner 8, as illustrated. The bow is grasped by hand grip 12, and arrow retainer 14 is mounted to that flat portion of frame 2 located immediately above hand grip 12 in order to more easily facilitate the positioning, nocking and drawing of an arrow 13, as illustrated in FIG. 2.

Referring now to FIGS. 2, 3, 5 and 7 of the drawing, the arrow retainer 14 of this invention is illustrated in cocked position ready to receive an arrow 13, as indicated in FIG. 2. Arrow retainer 14 is characterized by a generally flat base plate 15, having an upwardly extending support 16 carried by one end of base plate 15 and, in a preferred embodiment, formed integrally with base plate 15. Support 16 is tensioned in order to facilitate a return to the original position upon being depressed, and extends longitudinally over a portion of the length of base plate 15. Support 16 is also provided with a notch 18 and a bevel 32 at the extended end thereof, with a support pad 17 positioned adjacent the notch 18. A pair of brackets 19 are provided on each side of base plate 15 and, in a preferred embodiment, are also formed integrally with base plate 15, turned upwardly, and provided with apertures to receive a bracket pin 20, spanning the distance between brackets 19 and registering with the apertures therein. Bracket pin 20 is also provided with pin brads 21 at each end thereof. A pair of retaining arms 22 are positioned in upward standing, spaced and rotatable relationship on bracket pin 20, and are fitted with a pair of arm pads 23 for engaging an arrow, as illustrated in FIG. 2. The bases of retaining arms 22 are coiled around bracket pin 20 to form retaining arm coils 24, which terminate in an upward standing support arm 25. Support arm 25 is positioned in generally parallel relationship to retaining arms 22 and is formed in a generally U-shaped configuration with the top portion adapted for removable engagement with notch 18 of support 16, as illustrated. A spring 26 is also provided on bracket pin 20 between retaining arm coils 24, with one end extending in biased cooperation with one of the retaining arms 22, and the opposite end positioned against base plate 15 to bias retaining arms 22 and support arm 25 forwardly. Mount apertures 30 are also provided in base plate 15 in order to mount base plate 15 on frame 2.

Referring now specifically to FIGS. 1–3, 5 and 9 of the drawing, in a preferred embodiment of the invention an adjusting screw 27 is provided in cooperation with an adjusting bolt 28 mounted on base plate 15 of arrow retainer 14, in order to adjust the relative position of arrow retainer 14 with respect to the frame 2 of compound bow 1. This adjustment facilitates a variation in the lateral pressure exerted by arrow 13 against support pad 17 and support 16 as the arrow leaves the compound bow 1. The lateral pressure exerted by the arrow is a function of the extent to which the point of the arrow is out of alignment with the plane of the bow string. Accordingly, as particularly illustrated in FIG. 9, with adjusting bolt 28 secured to base plate 15 and the bottom end of adjusting screw 27 projecting downwardly in a registering aperture in frame 2, manipulation of adjusting screw 27 by means of a screwdriver causes threads 29 to cooperate with the internal threads of adjusting bolt 28 to raise or lower base plate 15 on frame 2, as desired.

Figure 4:
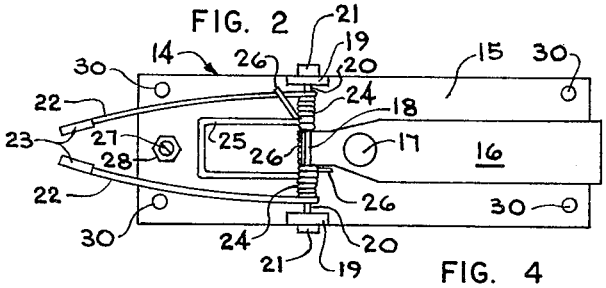
FIG. 4 is a top elevation of the arrow positioner illustrated in FIG. 3 in released configuration.
Figure 5:
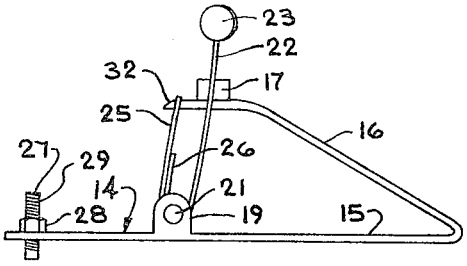
FIG. 5 is a right side elevation of the arrow retainer illustrated in FIG. 3.
Figure 6:
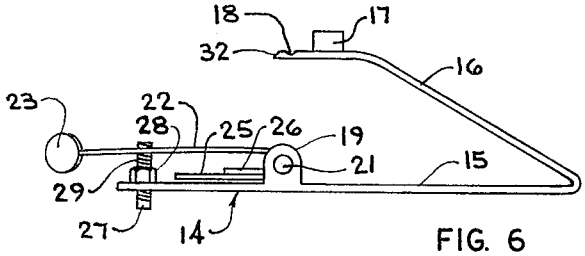
FIG. 6 is a right side elevation of the arrow retainer illustrated in FIG. 4.
Figure 7:
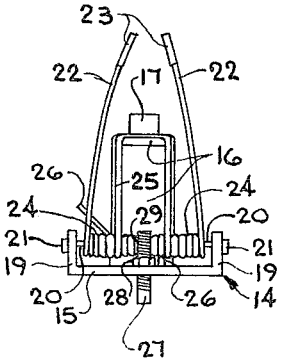
FIG. 7 is a front elevation of the arrow retainer illustrated in FIGS. 3 and 5.
Figure 8:
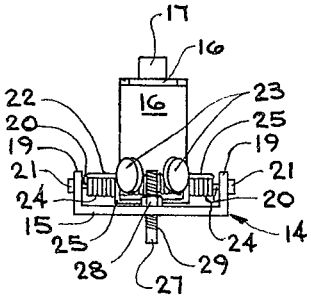
FIG. 8 is a front elevation of the arrow retainer illustrated in FIGS. 4 and 6.
Figure 9:
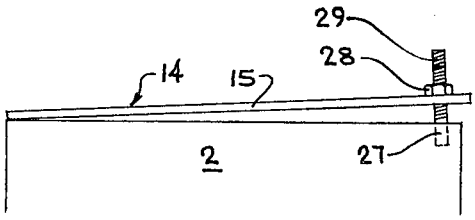
FIG. 9 is a side elevation of the arrow retainer base plate, more particularly illustrating the function of the adjusting screw and adjusting bolt to alter the position of the arrow retainer on the bow frame and adjust lateral pressure of a released arrow.

Referring now to FIGS. 4, 6 and 8 of the drawing, in operation, when the bow string 9 of compound bow 1 is released and arrow 13 is caused to move forward by the reaction of the bow string, lateral pressure is exerted by arrow 13 on support pad 17 and support 16 of arrow retainer 14. This pressure causes support 16 to depress and to disengage the top of support arm 25 from notch 18, and both support arm 25 and retaining arm 22 then move forward responsive to the bias of spring 26, to release arrow 13. Support arm 25 and retaining arm 22 are forced by spring 26 into the configuration illustrated in FIGS. 4, 6 and 8 upon release of bow string 9 and arrow 13 to provide a clear flight path for the arrow 13, and unobstructed passage of the arrow fletching mounted on the rear end of the arrow. The arrow release 14 therefore provides a simple, easy and effective rest for the arrow prior to and after release from the bow.

It will be appreciated by those skilled in the art that the arrow retainer of this invention provides a simple, effective and positive retaining means for a nocked arrow in substantially any type of bow. Accordingly, the retainer can be mounted on a recurve, long bow, or a compound bow, as illustrated in FIGS. 1 and 2 of the drawing, according to the needs and desires of the user. In use, the arrow 13 is simply nocked and placed between retaining arms 22, and is then drawn to the desired point with the arrow securely positioned for aiming. Neither abrupt movement of the bow nor wind is capable of dislodging the arrow from its secure position between the retaining arms, and a much more positive aim and release is possible than is the case with conventional arrow rests. A smooth release of arrow 13 from the bow can be achieved by manipulating adjusting screw 27 to adjust the lateral pressure of the arrow against support 16, as heretofore described.

Having described my invention with the particularity set forth above, what is claimed is:

1. An arrow retainer for releasing an arrow from a bow responsive to lateral arrow pressure comprising:

(a) a base plate for mounting on the bow;

(b) a support extending upwardly from said base plate and over a portion of said base plate and having a free standing, extending end;

(c) retaining means provided in said extending end of said support for receiving a support arm;

(d) a support arm pivotally carried by said base plate and engaging said retaining means when an arrow is situated in the bow;

(e) a pair of arrow-engaging retaining arms pivotally carried by said base plate and cooperating with said support arm in essentially parallel relationship; and (f) bias means engaging one of said retaining arms to bias said retaining arms and said support arm forward of said extending end of said support responsive to depression of said extending end from lateral pressure exerted by said arrow and release of said support arm from said retaining means, when an arrow is released.

2. The arrow retainer of claim 1 further comprising bracket means on said base plate and a bracket pin carried by said bracket means and supporting said support arm and said retaining arms.

3. The arrow retainer of claim 1 wherein said bias means is a spring.

4. The arrow retainer of claim 1 wherein said bias means is a coil spring, and further comprising a pair of brackets on said base plate and a bracket pin carried by said brackets and supporting said support arm, said retaining arms and said coil spring.

5. The arrow retainer of claim 1 wherein said retaining means is a notch provided in the top surface of said extending end of said support.

6. The arrow retainer of claim 1 wherein said support arm and said retaining arms are shaped from a single length of wire.

7. The arrow retainer of claim 1 further comprising a pair of brackets formed integrally with said base plate and positioned in upward standing, spaced relationship, and a bracket pin carried by said brackets and pivotally supporting said support arm and said retaining arms.

8. The arrow retainer of claim 1 wherein said support arm is formed integrally with said base plate, said retaining means is a notch provided in the top surface of said extending end of said support, and said bias means is a spring.

9. The arrow retainer of claim 1 further comprising a pair of brackets formed integrally with said base plate and positioned in upward standing, spaced relationship, and a bracket pin carried by said brackets and pivotally supporting said support arm and said retaining arms; and wherein:

(a) said support arm is formed integrally with said base plate, said retaining means is a notch provided in the top surface of said extending end of said support, and said bias means is a spring; and (b) said support arm and said retaining arms are shaped from a single length of wire.

10. An arrow retainer for releasing the forward end of an arrow from a bow responsive to lateral pressure of the arrow comprising:

(a) a base plate for mounting on the frame of the bow;

(b) a support extending upwardly from said base plate and over a selected portion of said base plate in space, tensioned relationship and having a free standing, extending end;

(c) a groove provided in the top surface of said extending end of said support for receiving a support arm;

(d) a pair of brackets mounted on said base plate in spaced relationship and a bracket pin carried by said brackets;

(e) a support arm pivotally carried by said bracket pin and engaging said groove in said extending end of said support when an arrow is situated in the bow;

(f) a pair of arrow-engaging retainer arms pivotally carried by said bracket pin and mounted in essentially parallel, cooperating relationship with said support arm; and (g) a spring mounted on said bracket pin and engaging one of said retaining arms to bias said retaining arms and said support arm forward of said extending end of said support responsive to depression of said extending end from lateral pressure exerted by an arrow when the arrow is released from the bow.

11. The arrow retainer of claim 10 wherein said support arm and said retaining arms are shaped from a single length of wire pivotally wound on said bracket pin.

* * * * *